US010093070B2

(12) United States Patent
Lintala et al.

(10) Patent No.: US 10,093,070 B2
(45) **Date of Patent: *Oct. 9, 2018**

(54) DUNNAGE CONVERSION SYSTEM AND METHOD WITH STOCK SUPPLY ALIGNMENT

(71) Applicant: Ranpak Corp., Concord Township, OH (US)

(72) Inventors: Edward W. Lintala, Concord, OH (US); Carrie Schlegel, Ashtabula, OH (US)

(73) Assignee: RANPAK CORP., Concord Township ( * ) Notice: Subject to any disclaimer, the term of this patent is extended or adjusted under 35 U.S.C. 154(b) by 0 days.

This patent is subject to a terminal disclaimer.

(21) Appl. No.: 15/360,611

(22) Filed: Nov. 23, 2016

(65) Prior Publication Data

US 2017/0087791 A1 Mar. 30, 2017

Related U.S. Application Data

(62) Division of application No. 13/885,214, filed as application No. PCT/US2011/060542 on Nov. 14, 2011, now Pat. No. 9,533,465.

(Continued)

(51) Int. Cl.
*B31D 5/00* (2017.01)

(52) U.S. Cl.
CPC .... *B31D 5/0043* (2013.01); *B31D 2205/0035* (2013.01); *B31D 2205/0047* (2013.01); *B31D 2205/0076* (2013.01)

(58) Field of Classification Search
CPC .... B31D 99/00; B31D 5/0047; B31D 5/0043; B31D 5/0039; B31D 2205/0017;

(Continued)

(56) References Cited

U.S. PATENT DOCUMENTS 2,135,814 A * 11/1938 Hearn ..... B42F 7/10 206/449
2,233,730 A * 3/1941 Britton ..... B65H 1/04 271/168

(Continued)

FOREIGN PATENT DOCUMENTS

DE 10 2005 05664 5/2007
WO 2001/094107 12/2001

(Continued)

OTHER PUBLICATIONS

International Search Report and Written Opinion of corresponding International Application No. PCT/US2011/060542, dated Oct. 18, 2012.

(Continued)

*Primary Examiner* — Nathaniel Chukwurah
*Assistant Examiner* — Eduardo R Ferrero
(74) *Attorney, Agent, or Firm* — Renner, Otto, Boisselle & Sklar, LLP

(57) ABSTRACT

A dunnage-producing system includes a dunnage conversion machine for converting a stock material into a relatively less dense dunnage product, a supply of stock material, and a guide element. The conversion machine is rotatable about a substantially vertical axis. The supply of stock material includes a support for the stock material that is movable relative to the conversion machine, such as for replenishing the stock material. The guide element is rotatable with the conversion machine to maintain a consistent position relative to the conversion machine, thereby consistently positioning the support relative to the conversion machine to avoid tearing or jamming problems associated with an improperly aligned supply of sheet stock material.

10 Claims, 10 Drawing Sheets

Related U.S. Application Data

(60) Provisional application No. 61/414,306, filed on Nov. 16, 2010.

(58) Field of Classification Search
CPC .... B31D 2205/0035; B31D 2205/0047; B31D 2205/0082; B31D 2205/0094; B31D 2205/76; B35D 5/0047
See application file for complete search history.

(56) References Cited

U.S. PATENT DOCUMENTS 3,137,043 A * 6/1964 Moeller ..... E06B 9/367 160/178.1 R
3,509,797 A * 5/1970 Johnson ..... B31D 5/0047 425/214
4,557,716 A * 12/1985 Ottaviano ..... B31D 5/0047 242/557
4,650,456 A * 3/1987 Armington ..... B31D 5/0047 242/557
4,750,896 A * 6/1988 Komaransky ..... B31D 5/0047 493/357
5,088,713 A * 2/1992 Hayashi ..... G03G 15/234 271/108
5,123,889 A * 6/1992 Armington ..... B26D 1/08 493/346
5,131,903 A * 7/1992 Levine ..... B31D 5/0043 206/395
5,203,761 A * 4/1993 Reichental ..... B26D 1/185 493/346
5,322,477 A * 6/1994 Armington ..... B26D 1/30 493/346
5,593,376 A * 1/1997 Armington ..... B31D 5/0047 493/346
5,637,071 A * 6/1997 Simmons ..... B31D 5/0047 493/464
5,989,176 A * 11/1999 Ratzel ..... B31D 5/0047 493/464
6,080,097 A * 6/2000 Ratzel ..... B23O 5/348 493/346
6,095,454 A * 8/2000 Simmons, Jr. ..... B31D 5/0047 242/559
6,402,674 B1 * 6/2002 Simmons, Jr. ..... B31D 5/0047 493/24
6,676,589 B2 1/2004 Kung et al.
6,699,167 B2 * 3/2004 Manley ..... B31D 5/0047 493/302
7,186,208 B2 * 3/2007 Demers ..... B26F 3/02 493/350
7,722,519 B2 * 5/2010 Timmers ..... B31D 5/0047 493/352
7,744,519 B2 * 6/2010 Wetsch ..... B31D 5/0052 493/464
8,267,848 B2 * 9/2012 Wetsch ..... B31D 5/0052 493/346
9,321,235 B2 * 4/2016 Cheich ..... B31D 5/0047
2003/0216236 A1 * 11/2003 Harding ..... B31D 5/0047 493/350
2007/0287623 A1 * 12/2007 Carlson ..... B31D 5/0047 493/464
2008/0070773 A1 * 3/2008 Wetsch ..... B31D 5/0052 493/464
2008/0207421 A1 * 8/2008 Wetsch ..... B31D 5/0052 493/464
2009/0075800 A1 * 3/2009 Wetsch ..... B31D 5/006 493/464
2009/0082187 A1 * 3/2009 Cheich ..... B31D 5/0047 493/350
2009/0226287 A1 * 9/2009 Keller ..... B31D 5/0043 414/226.04
2011/0053749 A1 * 3/2011 Wetsch ..... B31D 5/006 493/464
2011/0053750 A1 * 3/2011 Wetsch ..... B31D 5/0052 493/464
2012/0289392 A1 * 11/2012 Cheich ..... B31D 5/0047 493/464
2012/0329629 A1 * 12/2012 Wetsch ..... B31D 5/006 493/464

FOREIGN PATENT DOCUMENTS

WO 2004/039571 5/2004
WO 2009/126838 10/2009

OTHER PUBLICATIONS

Written Opinion of corresponding International Application No. PCT/US2011/060542, dated Apr. 25, 2013.

* cited by examiner

DUNNAGE CONVERSION SYSTEM AND METHOD WITH STOCK SUPPLY ALIGNMENT

This application is a divisional of U.S. patent application Ser. No. 14/885,214, filed on May 14, 2013, which claims the benefit of International Application No. PCT/US2011/060542, filed on Nov. 14, 2011, which claims the benefit of U.S. Provisional Patent Application No. 61/414,306, filed Nov. 16, 2010, each of which is hereby incorporated herein by reference.

FIELD OF THE INVENTION

This invention relates generally to a dunnage conversion system for converting a sheet stock material into a dunnage product, and more particularly for such a system and method with provisions for aligning the supply of stock material with a dunnage conversion machine.

BACKGROUND

In the process of shipping one or more articles in container, such as a cardboard box, from one location to another, a packer typically places some type of dunnage material in the shipping container along with the article or articles to be shipped. The dunnage material partially or completely fills the empty space or void volume around the articles in the container. By filling the void volume or cushioning or otherwise protecting the article, the dunnage prevents or minimizes damage to the articles during shipment.

To use storage space more efficiently, a dunnage conversion machine can be used to convert a supply of stock material, such as a roll or stack of paper, into a lower density dunnage product. For example, U.S. Pat. No. 6,676,589 discloses an exemplary dunnage conversion machine that can convert a continuous sheet of paper into a crumpled strip of void-fill dunnage. This patent is hereby incorporated herein by reference. Such a converter can convert a compact supply of stock material into a much greater volume of dunnage.

SUMMARY OF THE INVENTION

The present invention provides a dunnage-producing system that includes a dunnage conversion machine for converting a stock material into a relatively less dense dunnage product, a supply of stock material, and a guide element for accurately positioning the supply relative to the machine.

In one embodiment, the conversion machine is rotatable about a substantially vertical axis. The supply of stock material includes a support for the stock material that is movable relative to the conversion machine, such as for replenishing the stock material. The guide element is rotatable with or otherwise fixed relative to the conversion machine to maintain a consistent position relative to the conversion machine, thereby consistently positioning the support relative to the conversion machine to avoid tearing or jamming problems associated with an improperly aligned supply of sheet stock material.

The present invention also provides system for converting a stock material into a dunnage product that includes means for converting a sheet stock material into a dunnage product, a supply of sheet stock material including a mobile support, and means for consistently positioning the mobile support relative to the converting means. In one variation, the converting means is rotatable about a generally upright axis, and in another variation the converting means is fixed relative to the upright axis and the mobile support is movable along a linear guide to a stop adjacent the converting means.

In an exemplary system, the converting means can include a dunnage conversion machine, the mobile support includes a cart for a generally rectangular stack of fan-folded sheet stock material, and the positioning means includes a guide bracket having a pair of spaced-apart guide arms that engage opposing sides of the cart to position the cart relative to the conversion machine.

The present invention also provides a method that includes the following steps: (a) positioning a supply of sheet stock material relative to a dunnage conversion machine, and (b) operating the machine to convert the stock material to dunnage. The positioning step includes moving the supply of sheet stock material into engagement with a guide element that consistently positions the stock material relative to the machine. The method may further include the step of rotating the conversion machine about a generally vertical axis, where the rotating step includes rotating the guide element with the conversion machine.

In an alternative embodiment, the converting means, such as a dunnage conversion machine, is not rotatable, but remains in a fixed position with respect to an upright axis. The guide means in this system includes at least one guide element or rail along which the stock support is movable. The stock support is movable between an operating position adjacent to and aligned with the converting means, and a loading position removed from the operating position to provide access to the converting means or to facilitate loading stock material onto the support.

A further aspect of the invention provides a dunnage-producing system, comprising: a dunnage conversion machine for converting a sheet stock material into a relatively less dense dunnage product, a supply of sheet stock material, and an adjustable wind guard that protects the stock material from blowing out of the supply in windy conditions.

The present invention also provides a wind guard for a dunnage-producing system with a dunnage conversion machine for converting a sheet stock material into a relatively less dense dunnage product and a supply of sheet stock material, the wind guard comprising a panel that shields the stock material from wind and one or more height-adjustable supports extendable above the panel to support the stock material in windy conditions.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Many previous systems that converted sheet stock material into dunnage provided a supply of stock material in a fixed location relative to a conversion machine. If the conversion machine rotated or otherwise moved, the stock supply moved with it. This arrangement generally guaranteed that the stock material would assume the proper orientation as it fed into the conversion machine.

When the stock material is provided on a cart or other support that is movable relative to the conversion machine, so that a depleted supply can be replaced with a fresh supply, the relative movement between the stock supply and the conversion machine means that their relative orientation and positions are no longer guaranteed. If the straight edges of the sheet material are not aligned parallel to the feed direction, unintended problems can arise, such as jamming in the conversion machine, tearing of the sheet material, or less than ideal conversion of the sheet material into a dunnage product.

The present invention provides a system and method for consistently positioning the stock material relative to the conversion machine 22 to avoid tearing or jamming problems associated with an improperly aligned supply of sheet stock material.

Figure 1:
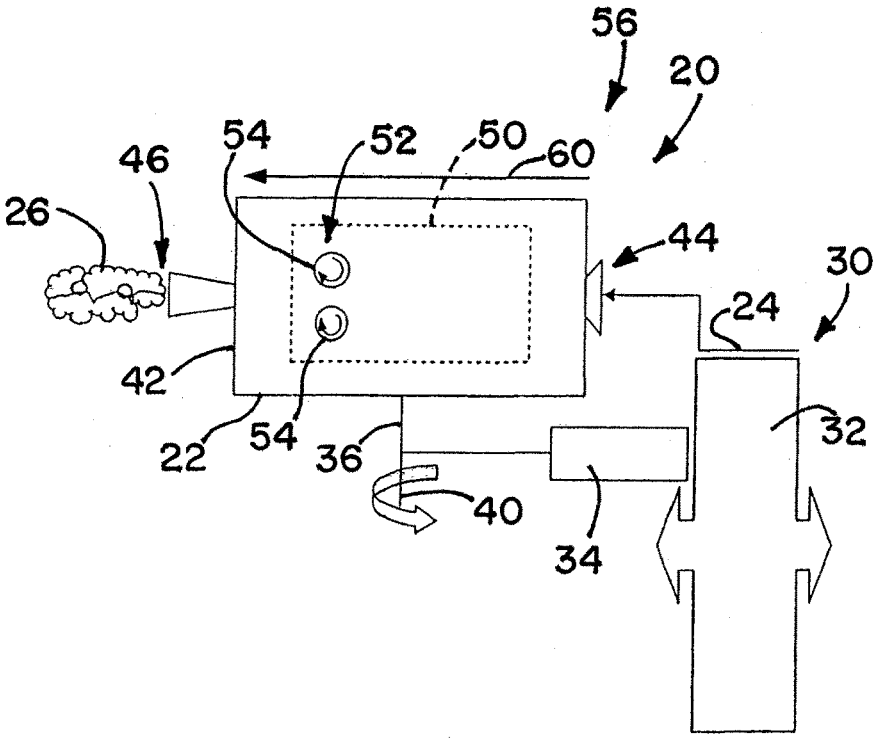
FIG. 1 is a schematic illustration of a dunnage conversion system provided in accordance with the invention.

Referring now to the drawings and initially FIG. 1, the illustrated system 20 includes a conversion machine 22, also referred to as a converter, for converting a sheet stock material 24 into a relatively less dense dunnage product 26, a supply 30 of sheet stock material including a movable support 32 for the stock material 24, and a guide element 34 for consistently positioning the stock support 32 relative to the converter 22. More particularly, the converter 22 is mounted to a stand 36 for rotation about a generally vertical axis 40, and the guide 34 is coupled to the stand 36 for rotation with the converter 22 so that when the stock support 32 engages the guide 34, the stock support 32 will always be properly positioned relative to the converter 22. In other words, the guide 34 is fixed relative to the converter 22.

The converter 22 has a housing 42 with an inlet 44 for receiving sheet stock material 24 and an outlet 46 for dispensing dunnage 26. The converter 22 also includes a conversion assembly 50, generally contained within the housing 42, for converting the stock material 24 into the dunnage product 26. The conversion assembly 50 has a movable element 52, such as a pair of opposed rotatable members 54, for moving the stock material 24 through the conversion assembly 50 as the stock material 24 is converted to the dunnage product 26. The stock material 24 moves from an upstream end 56 by the inlet 44 in a downstream direction 60 through the conversion assembly 50 to the outlet 46.

Figure 2:
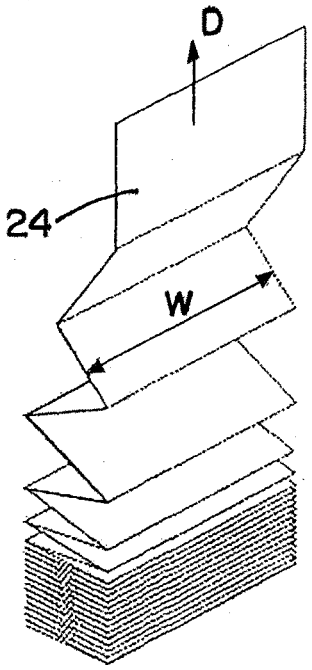
FIG. 2 is a perspective view of an exemplary stock material for use in a system provided in accordance with the invention.

The system 20 is not limited to a particular type of converter, as long as the converter 22 converts a sheet stock material 24, such as paper, into a strip of relatively lower density dunnage. The sheet stock material 24 can be provided in the form of a roll, a fan-folded stack, as shown in FIG. 2, or a stack of discrete sheets. In each case the sheet material has spaced apart edges that parallel the direction D in which the stock material is pulled from the stock supply 30, typically a direction perpendicular to the width W.

In the embodiment shown in FIGS. 3-8, a converter 22 is mounted to a stand 36 for rotation about a generally vertical axis 40. The illustrated stand 36 includes an upper member 64 and a lower member 66. These members 64 and 66 are telescopically coupled together and are rotatable relative to one another about a common axis, coincident with vertical axis 40. The converter 22 is mounted to the stand 36 such that the converter 22 rotates with the upper member 64. In the illustrated system the converter 22 also is mounted to the upper member 64 for rotation about a horizontal axis 70 to change the angle at which stock material enters and dunnage products exit the converter. As a further option, the upper and lower members 64 and 66 can be adjusted axially to change the height or elevation of the converter 22.

Both the converter 22 and the upper member 64 to which it is coupled rotate together relative to the lower member 66. The lower member 66 is coupled to a support member 72 to maintain the stand 36 in an upright orientation. The lower member 66 and the associated support 72 can be referred to as the base of the stand. In the illustrated embodiment, the lower member 66 includes a plurality of outwardly-extending feet 74 that enhance the stand's stability. The feet 74 extend under the stock support 32. The illustrated feet 74 include wheels 76, making the stand 36 mobile.

Figure 9:
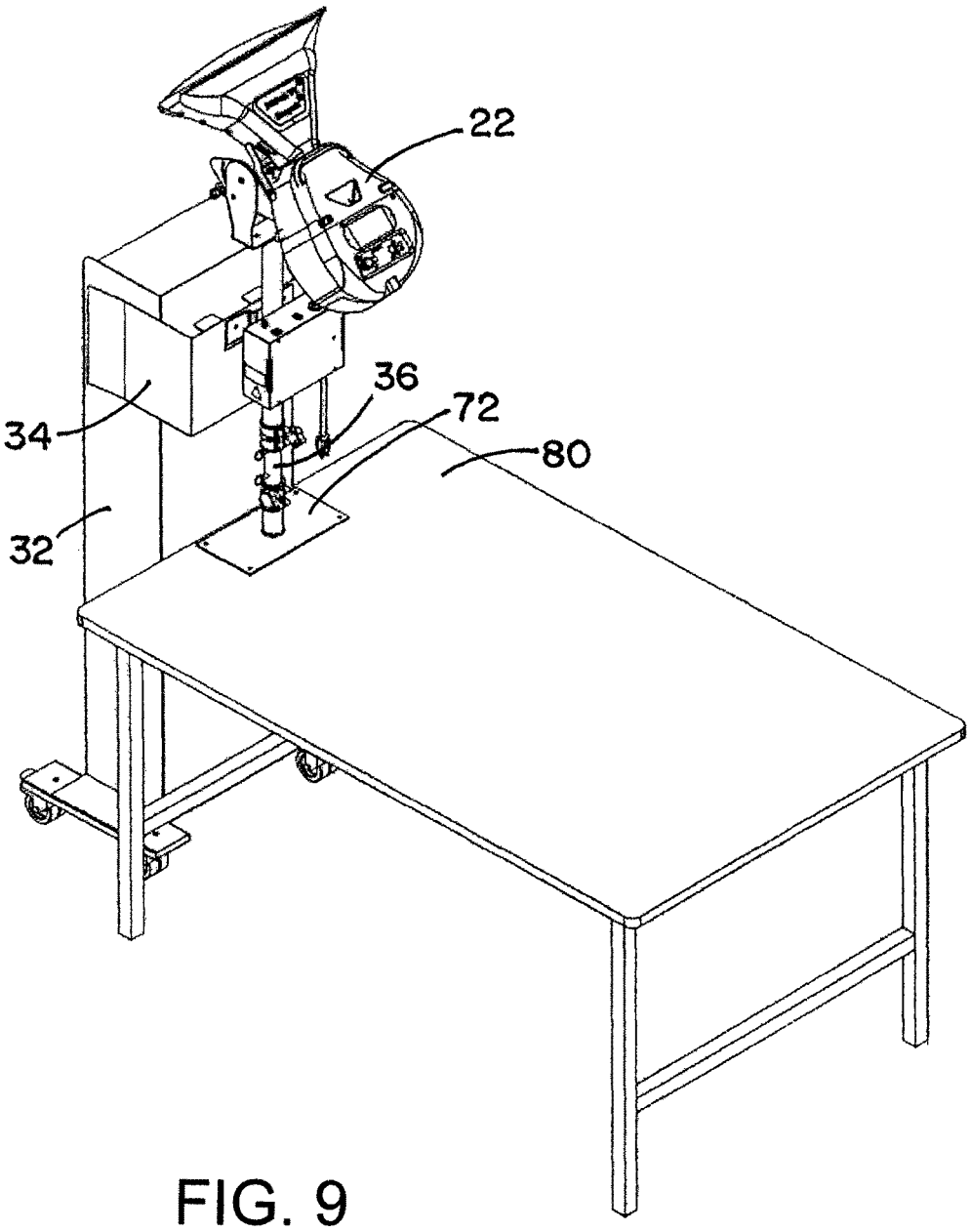
FIG. 9 is a perspective view of another exemplary system provided by the present invention.

Alternatively, the support member 72 can include a flat plate that can be fixedly secured to a stable surface, such as a floor or the illustrated table 80 of FIG. 9. The system shown in this alternative embodiment also includes a converter 22 mounted to a stand 36, where the converter 22 is mounted to an upper member 64 of the stand 36 for rotation together about a substantially vertical axis 40 relative to the lower member 66. Whether the stand 36 is secured to a table 80 (FIG. 9) or is mobile (FIGS. 3-8), a guide element 34 is secured to the upper member 64 for rotation with the upper member 64.

Since the upper member 64 is mounted for rotation relative to the lower member 66, and the upper member 64 also is coupled to the converter 22 such that the converter 22 cannot rotate about a vertical axis 40 independently of the upper member 64, the guide element 34 is rotatable about the vertical axis 40 with the converter 22. This means that when the stock support 32 engages the guide element 34, the stock support 32 will be consistently positioned relative to the converter 22 regardless of the relative position or orientation of the converter 22 about the vertical axis 40.

The illustrated guide element 34 has a generally U-shape cross section, with a central portion 82 connected to the stand 36, specifically the upper member 64 of the stand 36. A pair of spaced-apart arms 84 extend from the central portion 82. The arms 84 generally extend parallel to each other and in the same direction from the central portion 82. The illustrated arms 84 flare outwardly at their distal ends, however, which helps to funnel or guide the stock support 32 into engagement with the parallel portions of the arms 84. The arms 84 preferably are spaced to closely receive the sides of the stock support 32 between the parallel portions. Once the stock supply 30 is docked within the guide element 34, the stock support 32 also is aligned with the converter 22, specifically the inlet 44 to the converter 22. A vertical line through the center of the stock support 32 generally will fall within the same plane as a straight line passing through the center of the converter 22 parallel to the downstream direction taken by the path of the stock material 24 from the upstream end 56 to the downstream end 60. Other types of guide elements for docking a movable stock support relative to a dunnage converter are contemplated as being within the scope of the invention, such as a locating pin and recess combination, for example.

The stock support 32 is movable relative to the converter 22. This makes it easier to resupply the stock material 24, either by exchanging a full stock support 32 for an empty one, or moving the stock support 32 to a remote supply of stock material 24. In the illustrated embodiment the stock support 32 has wheels 86 that facilitate moving the stock support 32. In this arrangement, the stock support can be referred to as a cart.

The illustrated cart supports a fan-folded stack of sheet stock material (such as that shown in FIG. 2), and includes upright walls 90 that support the stack. The particular cart shown includes three upright side walls 90 that bound a generally rectangular space. This rectangular space is sized to receive a stack of fan-folded sheet stock material having a series of rectangular sheets connected at fold lines. The fold lines generally extend across the width of the stock material 24 and form longer sides of the rectangular stack.

In an exemplary arrangement, the stack of sheet stock material is formed of smaller stacks connected together. These smaller stacks typically are bundled separately and then connected together when stacked one on top of another. The illustrated cart can hold, for example, six of these smaller bundles of fan-folded sheet stock material connected together in one stack.

Figure 3:
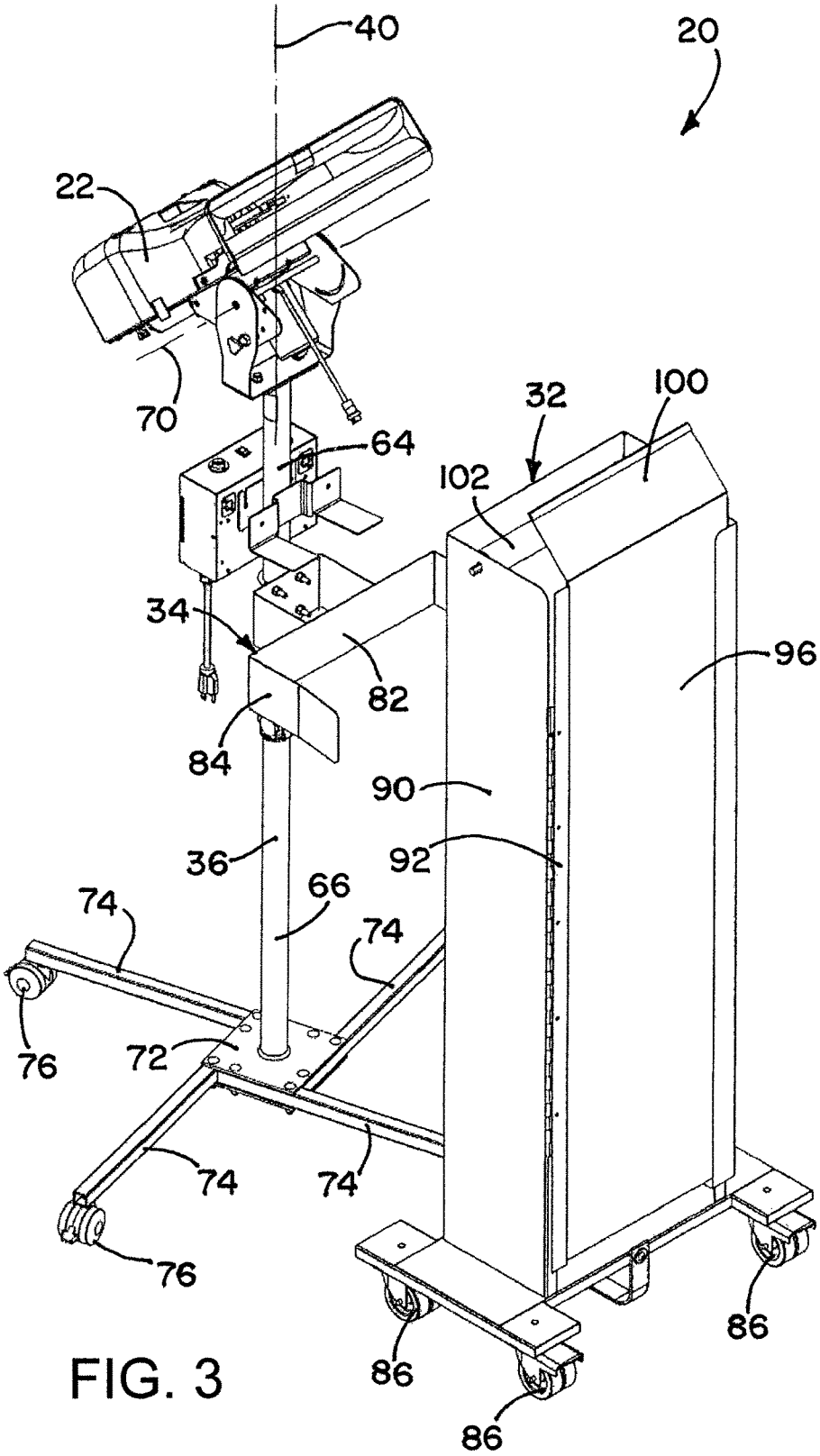
FIG. 3 is a perspective view of an exemplary system provided by the present invention.
Figure 4:
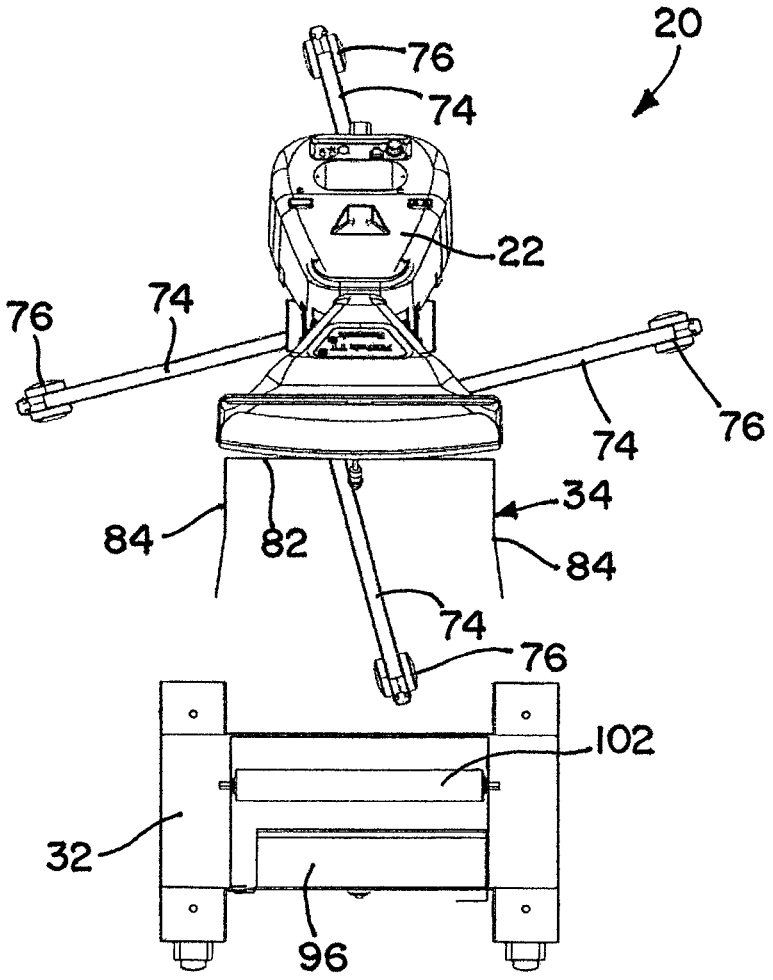
FIG. 4 is a top plan view of the system of FIG. 3.
Figure 5:
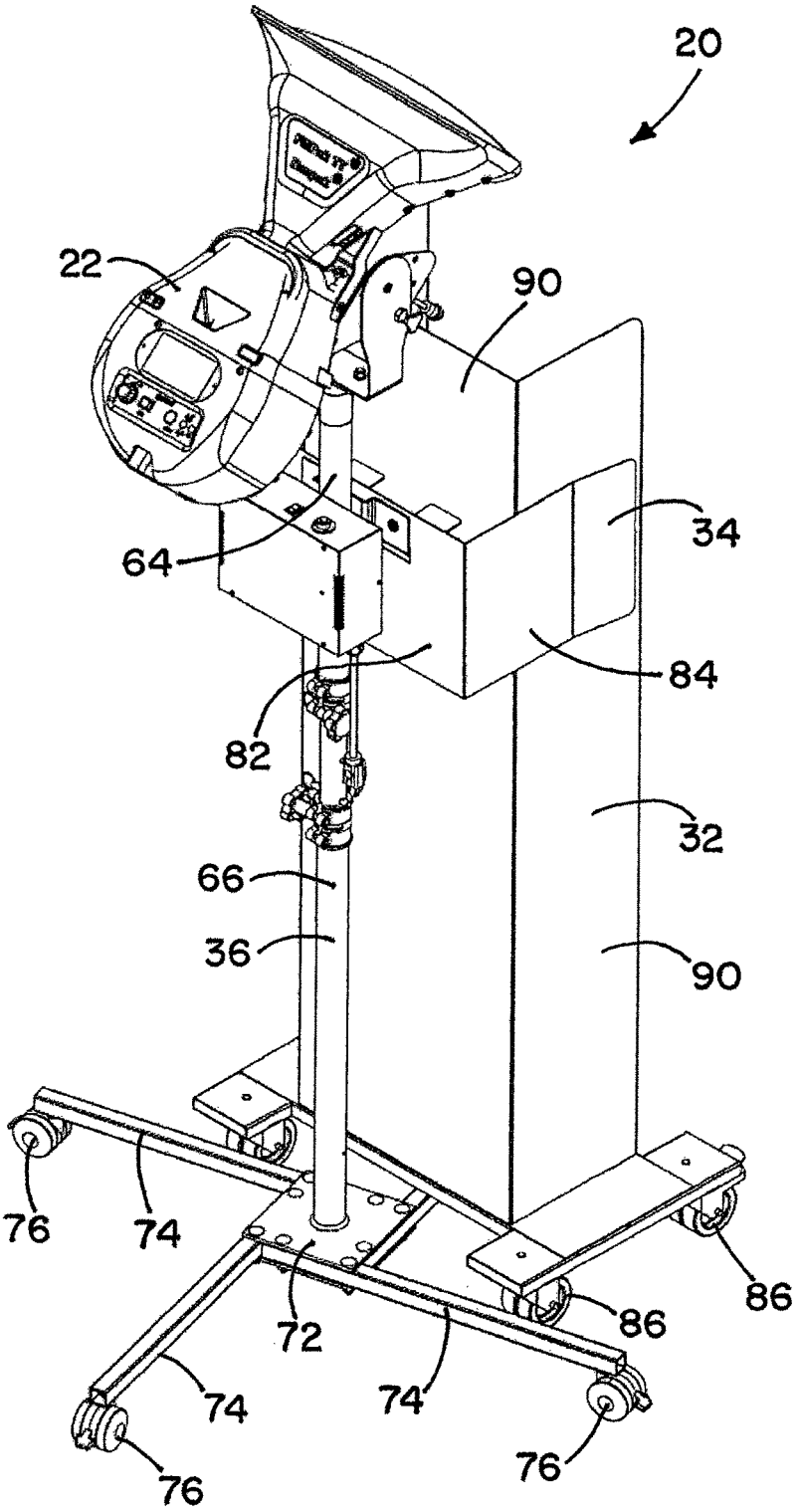
FIG. 5 is a perspective view of another exemplary system provided by the present invention.
Figure 6:
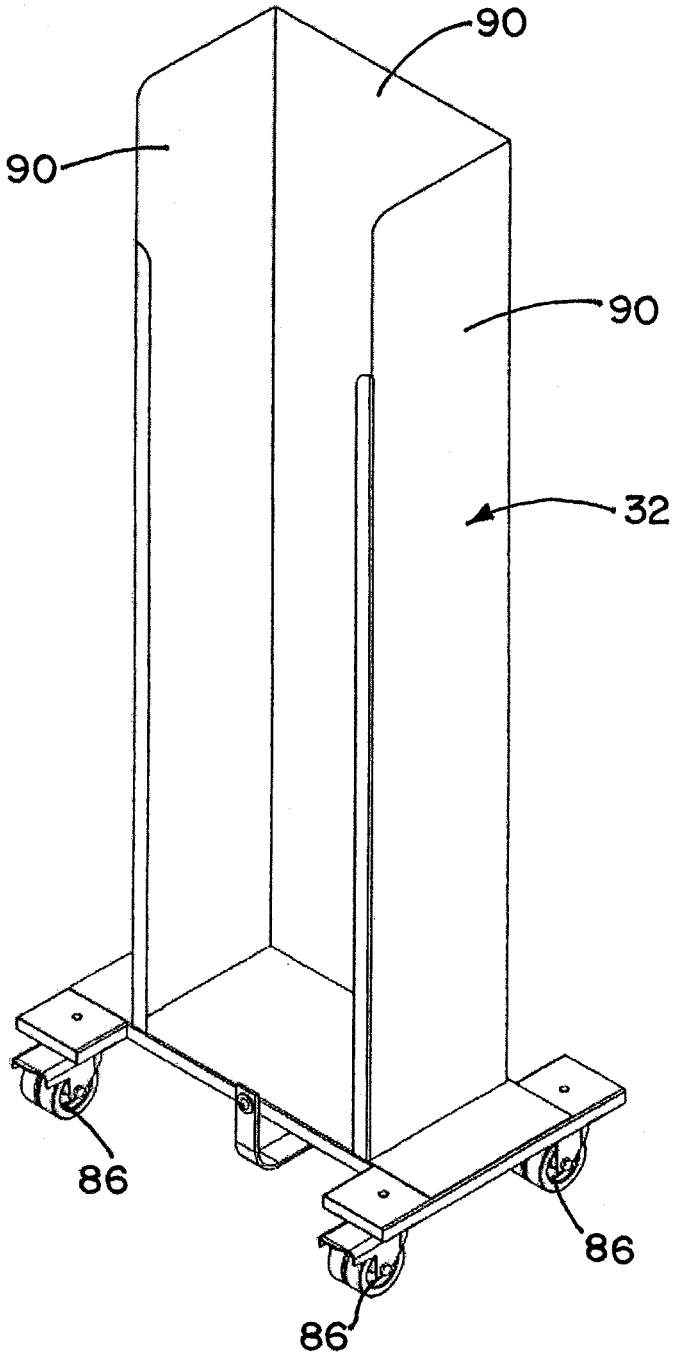
FIG. 6 is a perspective view of a stock supply cart portion of the system of FIG. 5.
Figure 7:
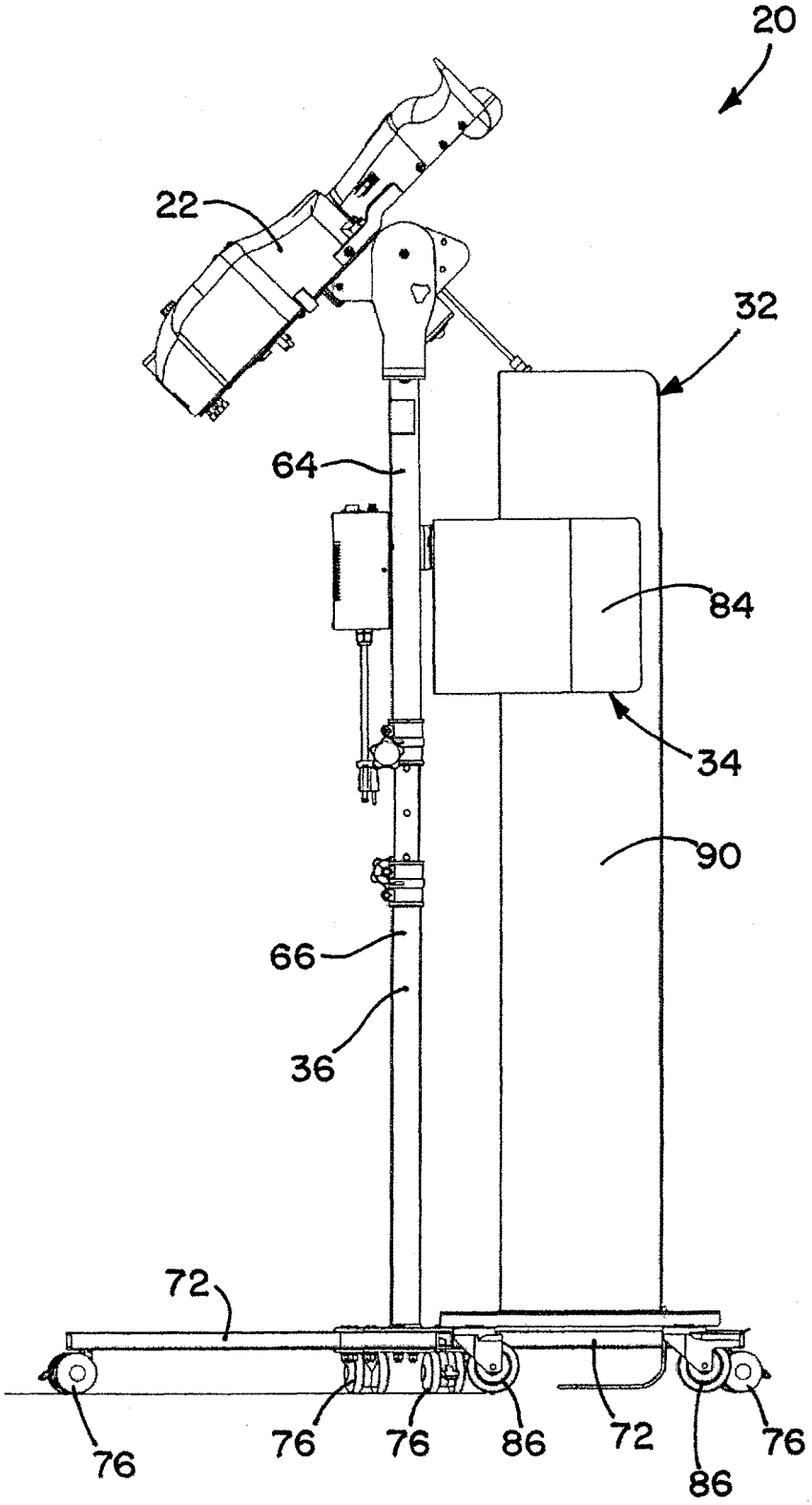
FIG. 7 is an elevation view of the system of FIG. 5.
Figure 8:
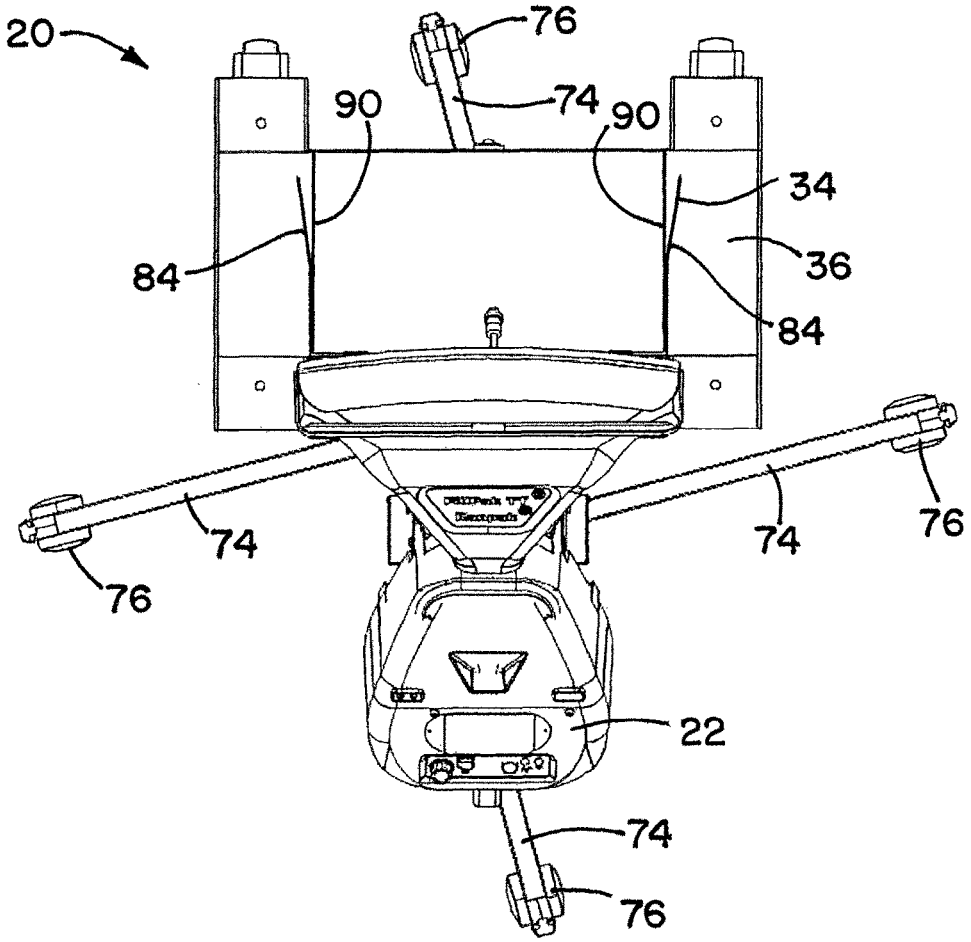
FIG. 8 is a top view of the system of FIG. 5.

The illustrated cart shown in FIGS. 3 and 4 also includes spring-biased hinged elements 92 on the open side 94 of the cart that can be opened to facilitate loading a new stack of sheet stock material 24 and then closed to hold the stack on the cart. This cart also includes an optional wind guard 96, a panel that closes the open side 94 of the cart. The wind guard 96 has an upper portion 100 that extends partially over the open top defined by the side walls to protect the stack from wind, whether natural or from a fan, for example, and prevents the stock material 24 from catching the wind and blowing out of the cart.

Near the top of the side walls the cart also includes a guide member 102, such as a bar or roller, to provide a constant taking-off point for the stock material 24 as it is drawn from the cart. The guide member 102 preferably extends parallel to a width dimension of the stock material 24 and perpendicular to the direction in which the stock material 24 is pulled from the cart. In the illustrated embodiment that means pulling the sheet stock material 24 in a direction generally parallel to the shorter sides of the rectangular sheets that form the stack, which is perpendicular to the fold lines. The guide member 102, hinged elements 92, and wind guard 96 are optional.

Accordingly, the present invention provides a dunnage-producing system that includes a dunnage conversion machine 22 for converting a stock material 24 into a relatively less dense dunnage product 26, a supply of stock material 30, and a guide element 34. The conversion machine 22 is rotatable about a substantially vertical axis 40. The supply 30 of stock material includes a support 32 for the stock material 24 that is movable relative to the conversion machine 22, such as for replenishing the stock material 24. The guide element 34 is rotatable with the conversion machine 22 to maintain a consistent position relative to the conversion machine 22, thereby consistently positioning the support 32 relative to the conversion machine 22 to avoid tearing or jamming problems associated with an improperly aligned supply of sheet stock material.

The present invention also provides a stock supply cart equipped with grooved casters that ride on an alignment guide or track, and a cart-positioning guide bracket. The cart is movable between an operating position along the alignment track to a loading position removed from the operating position to load a new supply of stock material in the cart. The positioning guide bracket locates the cart in proper alignment with the conversion machine at the operating position.

Figure 10:
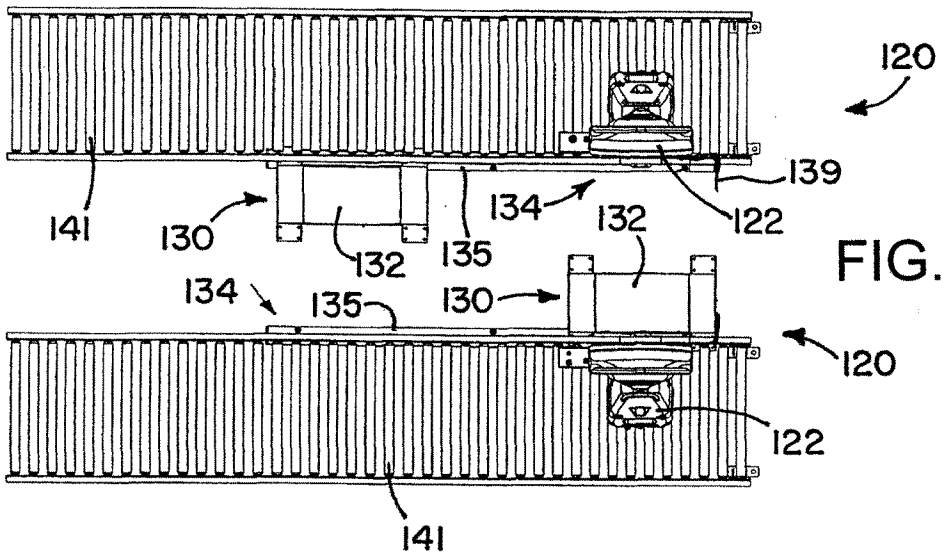
FIG. 10 is a top view of an alternative system provided in accordance with the invention.
Figure 12:
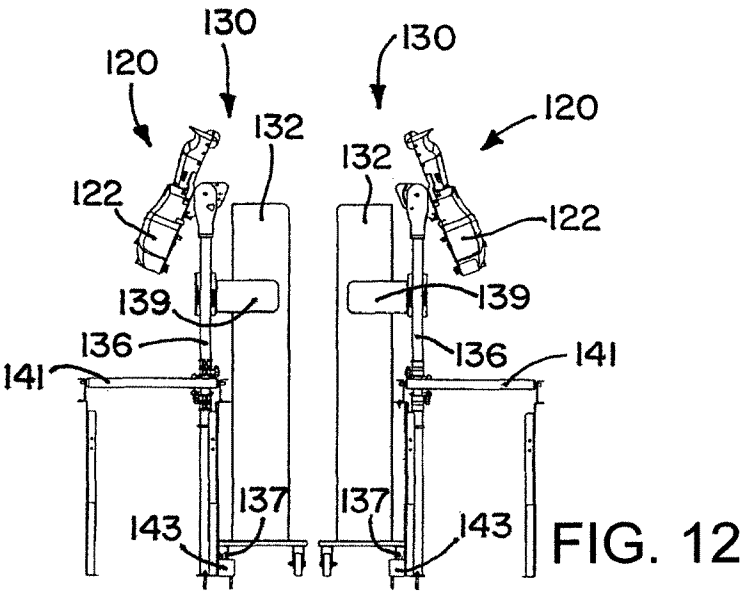
FIG. 12 is an end view of the system of FIG. 10.
Figure 11:
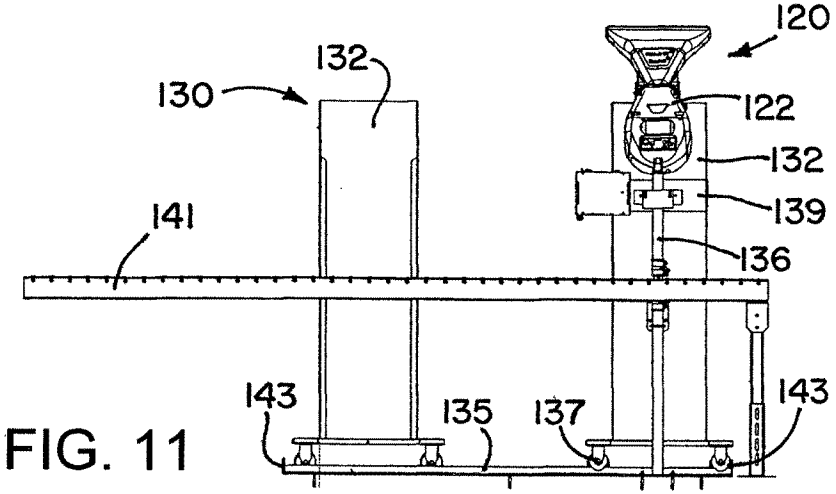
FIG. 11 is a side or elevation view of the system shown in FIG. 10.

More particularly, as in the previous embodiment the system 120 illustrated in FIGS. 10-12 includes a conversion machine 122 for converting a sheet stock material into a relatively less dense dunnage product. The system 120 also includes a supply 130 of sheet stock material including a movable support 132 for the stock material, and a guide element 134 for consistently positioning the stock support 132 relative to the converter 122. The conversion machine or other converting means used in this embodiment is substantially identical to the converter as shown and described in the previous embodiment. Reference numbers for this embodiment generally correspond to the reference numbers for the previous embodiment plus 100. The elements of corresponding reference numbers are substantially identical and interchangeable, except as specified.

The dunnage converter 122 in this embodiment is not rotatable about an upright axis, but as in the previous embodiment the guide element 134 remains in a fixed position relative to the converter 122. The guide element 134 (also referred to as a guide or guide means) in this system 120 includes at least one rail 135 mounted to the floor and on which the stock support 132 engages with mating casters or wheels 137. The rail 135 can be linear, as shown, but is not limited to a linear shape.

As in the previous embodiment, the converter 122 is mounted to a stand 136. The guide 134 also includes a stop member 139 mounted to the stand 136 at an elevated position. The stop member 139 also can be referred to as a stop or a cart-positioning guide bracket or simply a positioning guide or positioning bracket. The stop 139 extends from the stand 136 into the path of the mobile support to engage one side of the support 132 when the support is at its operating position. Thus the stock support 132, or cart, can be moved between the loading position removed from the converter 122 and the operating position adjacent the converter 122.

As shown in the illustrated figures, the converter 122 can be mounted over a conveyor 141 and the stock cart 132 and guide elements 134 can be positioned adjacent the conveyor. In this illustration, two systems 120 are shown, one having the stock support 132 at a loading position (upper system) and the other having the stock support 132 at an operating position (lower system). Other than the use of a guide rail 135 and wheels 137 that mate with the guide rail 135, the stock support 132 shown in this embodiment is substantially identical to the stock support 32 shown and described in the previous embodiment. The ends of the rails 135 include upturned elements 143 that provide stops for the wheels 137 at the distal ends of the rail 135, one end preferably also assisting the stop member 139, which is mounted to the stand 136 at an elevated position, in defining the operating position for the mobile support 132.

The guide element 134, including the rail 135 and the stop or stop member 139, facilitates consistently positioning the stock support 132 relative to the converter 122 to avoid tearing or jamming problems associated with an improperly aligned sheet stock material.

Another variation contemplated by the present invention is shown in FIGS. 13-16. The illustrated dunnage conversion system 200 includes a dunnage converter 202 and a stock supply in the form of a cart 204 with an improved wind guard 206. Like the wind guard 96 (FIG. 3), the wind guard 206 in this system 200 has a panel 210 that closes an open side of the stock supply cart 204. The wind guard 206 further includes one or more adjustable support members, and in this case two support members in the form of arches 212, formed by thin rods, that are supported by and extend upwardly from the panel 210. The sides of the arches 212 are narrower than the stock material supplied from the cart 204. The arches 212 can be flexible, and are adjustable between two positions, an up position (FIG. 16) for use in restraining the stock material from blowing in the wind as it travels from the supply 204 to the dunnage converter 202, and a down position (FIG. 15) for shipping or to facilitate loading a new supply of stock material or if they are not needed. In the down position (FIG. 15) the arches 212 slide into recesses in the panel 210, such that the panel 210 can protect the arches 212 during transport, for example.

Although other types of flexible materials can be used in place of the rods that form the illustrated arches 212, the arches 212 present a low profile to the wind, such that the wind can move substantially through the arches 212 if no stock material is in the way. Consequently, if another material were used in place of the illustrated rods, a low profile would be desirable to provide the same benefits provided by the arches 212. This design also adds minimal weight to the stock supply 204. Additionally, if a flexible material is used the arches 212 will bend and spring back if a gust of wind suddenly catches the stock material and blows it against the arches 212 temporarily.

Figure 13:
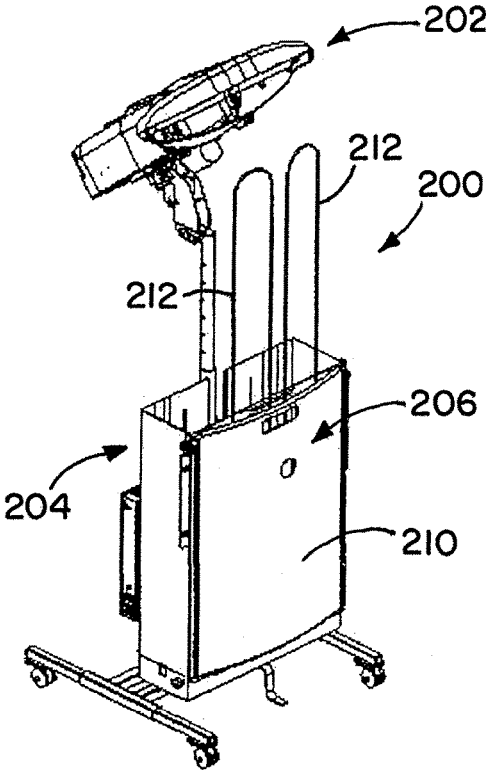
FIG. 13 is a perspective view of another dunnage conversion system provided by the present invention with an improved wind guard.
Figure 14:
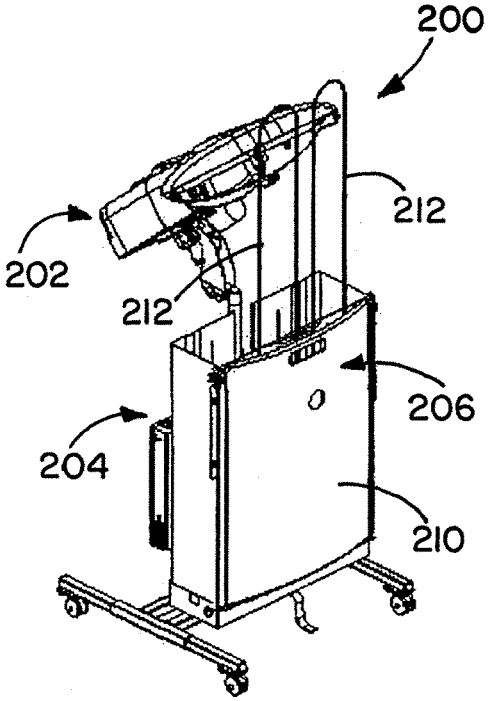
FIG. 14 is a perspective view of the system shown in FIG. 13 in a different configuration.
Figure 15:
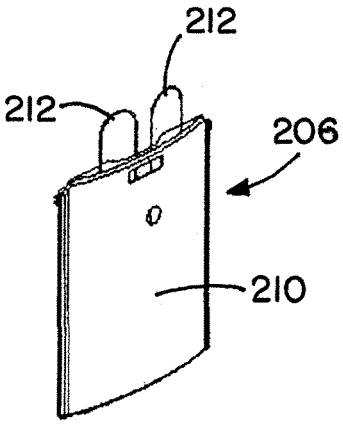
FIG. 15 is a perspective view of the wind guard of FIG. 13 in a different position.
Figure 16:
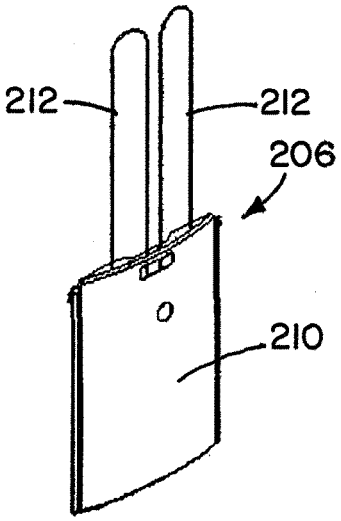
FIG. 16 is a perspective view of the wind guard of FIG. 15 in a different position.

The arches' 212 adjustable height also provides flexibility in accommodating different orientations of the dunnage converter 202. In FIG. 13 the converter 202 is at its highest position, and in FIG. 14 the converter 202 is at its lowest position, and in both positions the wind guard 206 provides the necessary support to the stock material. The wind guard 206 thus protects the stock material from windy conditions, whether natural or from a fan, for example, and prevents the stock material from catching the wind and blowing out of the stock supply 204 in all orientations of the dunnage converter 202.

The present invention can further be defined by one or more of the following clauses.

A. A dunnage-producing system 20, comprising: a dunnage conversion machine 22 for converting a stock material 24 into a relatively less dense dunnage product 26, the conversion machine 22 being rotatable about a substantially vertical axis 40; a supply of stock material 30, including a support 32 for the stock material 24 that is movable relative to the conversion machine 22; and a guide element 34 for consistently positioning the support 32 relative to the conversion machine 22, where the guide element 34 is rotatable with the conversion machine 22 to maintain a consistent position relative to the conversion machine 22.

B. A system 20, in combination with any other clause, where the conversion machine 22 includes a conversion assembly 50 with a movable member 52 for drawing stock material 24 through the machine 22.

C. A system 20, in combination with any other clause, where the stock material 24 includes a sheet stock material.

D. A system 20, in combination with any other clause, where the stock material 24 includes a substantially rectangular stack of fan-folded sheet stock material.

E. A system 20, in combination with any other clause, where the support 32 includes a plurality of upright walls 90 that bound a generally rectangular space for receiving a substantially rectangular stack of fan-folded sheet stock material.

F. A system 20, in combination with any other clause, comprising a stand 36 having an upright member 64 on which the conversion machine 22 is mounted for rotation.

G. A system 20, in combination with any other clause, comprising a stand 36 having an upper member 64 and a lower member 66 rotatable relative to one another about a common axis 40, where the conversion machine 22 is mounted to the stand 36 such that the conversion machine 22 rotates with the upper member 64.

H. A system 20, in combination with any other clause, comprising a stand 36 having an upper member 64 and a lower member 66 rotatable relative to one another about a common axis 40, where the guide element 34 is mounted to the stand 36 such that the guide element 34 rotates with the upper member 64.

I. A system 20, in combination with any other clause, comprising a stand 36 having an upper member 64 and a lower member 66 rotatable relative to one another about a common axis 40, where the conversion machine 22 and the guide element 34 are mounted to the stand 36 such that the conversion machine 22 and the guide element 34 rotate with the upper member 64.

J. A system 20, in combination with any other clause, where the guide element 34 has a generally U-shape cross section, with a central portion 82 mounted for rotation with the conversion machine 22 and a pair of spaced-apart arms 84 extending from the central portion 82 in a common direction to receive the stock support 32 between the arms 84.

K. A dunnage conversion machine 22 for converting a sheet stock material 24 into a dunnage product 26, a stand 36 on which the conversion machine 22 is mounted at an elevated position, a cart 32 for supporting a supply of sheet stock material 30, and a guide bracket mounted to the stand 36 to consistently position the cart 21 relative to the conversion machine 22.

L. A system 20 for converting a stock material 24 into a dunnage product 26, comprising:

means 22 for converting a sheet stock 24 material into a dunnage product 26;

a supply 30 of sheet stock material 34 including a mobile support 32; and means 34 for consistently positioning the mobile support 32 relative to the converting means 22.

M. A system 20 in combination with any other clause, where the converting means 22 is rotatable about a generally upright axis.

N. A system 120 in combination with any other clause, where the positioning means 134 includes at least one rail 135 along which the mobile support 132 is movable, and a stop 139 adjacent the converting means 122 to position the mobile support 132 relative to the converting means 122.

O. A system 20, in combination with any other clause, where the converting means includes a dunnage conversion machine 22, the mobile support 32 includes a cart for a generally rectangular stack of fan-folded sheet stock material 24, and the positioning means 34 includes a guide bracket having a pair of spaced-apart guide arms 84 that engage opposing sides of the cart 32 to position the cart relative to the conversion machine 22.

P. A method comprising the following steps:

positioning a supply 30 of sheet stock material 24 relative to a dunnage conversion machine 22; and operating the machine 22 to convert the stock material 24 to dunnage 26;

where the positioning step includes moving the supply 30 of sheet stock material into engagement with a guide element 34 that consistently positions the stock material 30 relative to the machine 22.

Q. A method, in combination with any other method clause, comprising the step of rotating the conversion machine 22 about a generally vertical axis 40, where the rotating step includes rotating the guide element 34 with the conversion machine 22.

R. A dunnage-producing system 20, comprising: a dunnage conversion machine 22 for converting a stock material 24 into a relatively less dense dunnage product 26; a supply 30 of stock material 24, including a support 32 for the stock material 24 that is movable relative to the conversion machine 22; and a guide element 34 for consistently positioning the support 32 relative to the conversion machine 22.

S. A dunnage-producing system, comprising: a dunnage conversion machine for converting a sheet stock material into a relatively less dense dunnage product, a supply of sheet stock material, and an adjustable wind guard that protects the stock material from blowing out of the supply in windy conditions.

T. A wind guard for a dunnage-producing system with a dunnage conversion machine for converting a sheet stock material into a relatively less dense dunnage product and a supply of sheet stock material, the wind guard comprising a panel that shields the stock material from wind and one or more height-adjustable supports extendable above the panel to support the stock material in windy conditions.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

We claim:

1. A dunnage-producing system, comprising: a dunnage conversion machine for converting a sheet stock material into a relatively less dense dunnage product, a supply of sheet stock material, and an adjustable wind guard having a panel that shields the stock material from wind and one or more height-adjustable supports mounted to the panel, where the support is adjustable between two positions, an up position extended above the panel for use in restraining the stock material from blowing in the wind as it travels from the supply to the dunnage converter, and a down position recessed in the panel.

2. A dunnage-producing system as set forth in claim 1, where the one or more height-adjustable supports includes a pair of height-adjustable supports.

3. A dunnage-producing system as set forth in claim 1, where the one or more height-adjustable supports extend across a width that is less than a width of the panel.

4. A dunnage-producing system as set forth in claim 1, where the height-adjustable supports are received in recesses in the panel.

5. A dunnage-producing system as set forth in claim 1, where the height-adjustable support has an inverted U-shape profile.

6. A dunnage-producing system as set forth in claim 5, where the height-adjustable support is made of a rod having an inverted U-shape profile.

7. A dunnage-producing system as set forth in claim 6, where the rod is made of a flexible material.

8. A dunnage-producing system as set forth in claim 1, where the supply of sheet stock material includes a support that includes a plurality of upright walls that bound a generally rectangular space for receiving a substantially rectangular stack of fan-folded sheet stock material, the panel closing an open side of the support.

9. A dunnage-producing system as set forth in claim 8, where the supply of sheet stock material includes a substantially rectangular stack of fan-folded sheet stock material supported between the upright walls of the support.

10. A dunnage-producing system as set forth in claim 8, where the support includes a plurality of wheels to form a cart.

* * * * *